US006067058A

United States Patent [19]

Volman

[11] Patent Number: 6,067,058

[45] Date of Patent: May 23, 2000

[54] END-FED SPIRAL ANTENNA, AND ARRAYS THEREOF

[75] Inventor: Vladimir Volman, Newtown, Pa.

[73] Assignee: Lockhead Martin Corporation, Sunnyvale, Calif.

[21] Appl. No.: 09/261,892

[22] Filed: Mar. 3, 1999

[51] Int. Cl.[7] ..... H01Q 1/36

[52] U.S. Cl. ..... 343/895; 343/846

[58] Field of Search ..... 343/895, 893, 343/846; H01Q 1/36

[56] References Cited

U.S. PATENT DOCUMENTS

| | | | |
|---|---|---|---|
| 3,778,839 | 12/1973 | Kovar | 343/895 |
| 4,583,099 | 4/1986 | Reilly et al. | 343/895 |
| 4,598,276 | 7/1986 | Tait | 343/895 |
| 4,843,404 | 6/1989 | Benge et al. | 343/895 |
| 5,258,771 | 11/1993 | Praba | 343/895 |
| 5,313,216 | 5/1994 | Wang et al. | 343/895 |
| 5,345,248 | 9/1994 | Hwang et al. | 343/895 |
| 5,781,110 | 7/1998 | Habeger, Jr. et al. | 343/895 |

*Primary Examiner*—Hoanganh Le
*Assistant Examiner*—Hoang Nguyen
*Attorney, Agent, or Firm*—W. H. Meise

[57] ABSTRACT

A planar spiral antenna is fed from the outer end, and one embodiment includes a capacitive plate adjacent the interior end. Two such planar spiral antennas are arrayed over a ground plane by the use of a phase shifter which provides a 90° phase difference between the two elements of the array. In this array, the rotational positions of the arrays differ by 90°. Two such two-spiral arrays are arrayed together, with elements of like phase delay diametrically opposite to each other in the overall array. This overall array has two feed ports, which are fed in parallel.

10 Claims, 9 Drawing Sheets

END-FED SPIRAL ANTENNA, AND ARRAYS THEREOF

FIELD OF THE INVENTION

This invention relates to antennas, and more particularly to (nominally) circularly-polarized antennas of the planar spiral type.

BACKGROUND OF THE INVENTION

Antennas are widely used for communication purposes and for radar or other sensing use. In general, an antenna must be adapted for the intended use. In some applications, high antenna gain is desired. High antenna gains are associated with high directivity, which in turn arises from a large radiating aperture. A common method for achieving a large radiating aperture is by the use of parabolic reflectors fed by a feed arrangement located at the focus of the parabolic reflector. Parabolic reflector type antennas can be very effective, but for certain purposes may present too much of a wind load, and for scanning use may have too much inertia to achieve the desired scanning acceleration. Also, reflector antennas in general suffer from the problem of aperture blockage attributable to the support structure required to support the feed antenna, and the feed antenna itself, which may adversely affect the field distribution over the surface of the reflector, and thereby perturb the far-field radiation pattern.

Modern communication and sensing systems find increasing use for antenna arrays. An antenna array includes an array or battery of usually-identical antennas or elements, each of which ordinarily has lower gain than the array antenna as a whole. The arrayed antenna elements are fed with an amplitude and phase distribution which establishes the far-field "radiation" pattern or beam. Since the phase and power applied to each antenna element of an array antenna can be individually controlled, the direction and characteristics of the beam can be controlled by control of the distribution of power (signal amplitude or gain) and phase over the antenna aperture. A salient advantage of an array antenna is the ability to scan the beam or beams electronically, without physically moving the mass of a reflector, or for that matter any mass whatever.

Many problems attend the use of array antennas. While a reflector is not necessary (although one may be used, if desired), achieving high gain still requires a large effective radiating aperture. The far-field radiation pattern of an array antenna is the product of the radiation pattern of one of the antenna elements, multiplied by the radiation pattern of a corresponding array of isotropic sources (sources which radiate uniformly in all directions), or in other words the product of the radiation pattern of an individual antenna element multiplied by the array factor. Thus, achieving high gain in an array antenna may require an array factor giving high gain, an individual antenna element having high gain, or both. The array factor can be increased to a certain extent by increasing the distance between individual element, but when the inter-element spacing becomes large, grating lobes may degrade the desired radiation pattern. Thus, achieving high gain in an array antenna may depend upon use of relatively high-gain antenna elements.

Those skilled in the art also know that one of the salient characteristics of an antenna is its field polarization. There are two general classes of field polarization, one of which is linear, and the other of which is circular. In the case of linear polarization, the electric field vector of the radiated beam appears, at a given location far from the antenna, as a line, which may be oriented in any desired direction, as for example vertically or horizontally. In the case of circular polarization, on the other hand, the electric field vector rotates in a plane orthogonal to the direction of propagation at a rate related to the frequency of the propagating wave. It should be noted that the term "circular" polarization refers to a theoretical condition which is approached only on rare occasions, and the term "circular" is often applied to imperfect circular polarization which would more properly be termed "elliptical".

When circular polarization is desired in the context of an array antenna, a circularly polarized antenna element is often used. U.S. Pat. No. 5,258,771, issued Nov. 2, 1993 in the name of Praba, describes an array antenna in which circular polarization is achieved by the use of axial-mode helical antennas. In the Praba arrangement, the axial mode helical antenna elements themselves have relatively high gain. For some applications, the three-dimensional axial-mode helices may be too large, and may, when arrayed, define an antenna which exceeds the available volume for its installation. For example, in many applications, such as for spacecraft or aircraft, small volume and light weight of an antenna array are extremely important.

Planar spiral antennas are known. Such planar spiral antennas are generally lightweight, and have small volume. Planar spiral antennas provide nominally circular polarization, but have other disadvantages. Some planar spiral antennas require installation in a "cup" to reduce radiation in the plane of the antenna. Many planar spiral antennas require a "balun" or balanced-to-unbalanced transformer. Baluns are undesirable, because of their bandwidth and or power limitations, and because they may require axial depth for effective operation.

SUMMARY OF THE INVENTION

An antenna according to an aspect of the invention includes a ground plane, and an elongated, electrically conductive element in the form of a planar spiral lying parallel to the ground plane. The planar spiral includes a central end and an outer end, and is centered near a point lying on a straight line connecting the central and outer ends of the spiral. The antenna includes a capacitive element. The capacitive element comprises an electrically conductive plate lying parallel to the plane of the planar spiral. The plate has a straight side and a curved side. The curved side of the plate is affixed to the edges of the elongated electrically conductive element at locations extending from the central end, over a first half-turn of the spiral, and beyond the first half-turn to a point at which the straight side of the plate makes a particular angle with the line. The antenna also includes a feed arrangement coupled to the ground plane and to the outer end of the electrically conductive element.

In a particular embodiment of the invention, the planar spiral is an Archimedean spiral, having more than two turns, and more particularly having 2 ½ turns, and the particular angle is 40°.

An antenna according to another embodiment of the invention includes a ground plane and a first elongated electrically conductive element in the form of a first planar spiral lying parallel to the ground plane. The first planar spiral includes a central end and an outer end, and is centered near a point lying on a first straight line connecting the central and outer ends of the first planar spiral. The antenna according to this other embodiment of the invention includes a second elongated electrically conductive element in the form of a second planar spiral, which is coplanar with the first planar spiral. The second planar spiral includes a central end and an outer end, and is centered near a point lying on a second straight line connecting the central and outer ends of the second planar spiral. An elongated electrically conductive phasing element extends, parallel with the ground plane and between the ground plane and the first and second spirals, from a first location to a second location. The first location lies on a line extending orthogonal to the ground plane and through the outer end of the first planar spiral, and the second location lies on a line extending orthogonal to the ground plane and through the outer end of the second planar spiral. An electrical conductor extends from the elongated electrically conductive phasing element at the first location to the outer end of the first spiral, and another electrical conductor extends from the elongated electrically conductive phasing element at the second location to the outer end of the second spiral. A feed arrangement is coupled to the ground plane and to a particular location on the electrically conductive phasing element, which particular location lies between the first and second locations. In this embodiment, the location on the electrically conductive phasing element may be selected to provide a 90° difference in phase at a selected operating frequency between the feed signals at the outer ends of the first and second spirals.

In a particular embodiment of the invention, the antenna further includes a first capacitive element comprising a first electrically conductive plate lying parallel to the plane of the first planar spiral. The first electrically conductive plate has a straight side and a curved side. The curved side is affixed to the edges of the elongated electrically conductive element of the first planar spiral at locations extending from the central end, over a first half-turn of the first planar spiral, and beyond the first half-turn to a point at which the straight side of the plate makes an angle, which in one embodiment may be about 40°, with the line.

In another particular embodiment of the invention, the antenna further includes a second capacitive element comprising a second electrically conductive plate lying parallel to the plane of the second planar spiral. The second plate has a straight side and a curved side. The curved side is affixed to the edges of the elongated electrically conductive element of the second planar spiral at locations extending from the central end, over a first half-turn of the second planar spiral, and beyond the first half-turn to a point at which the straight side of the plate makes the particular angle with the line.

In another embodiment, the first and second planar spirals are oriented relative to each other in such a fashion that the line extending from the central to the outer end of the first planar spiral is orthogonal to the line extending from the central to the outer end of the second planar spiral.

DESCRIPTION OF THE INVENTION

Figure 1A:
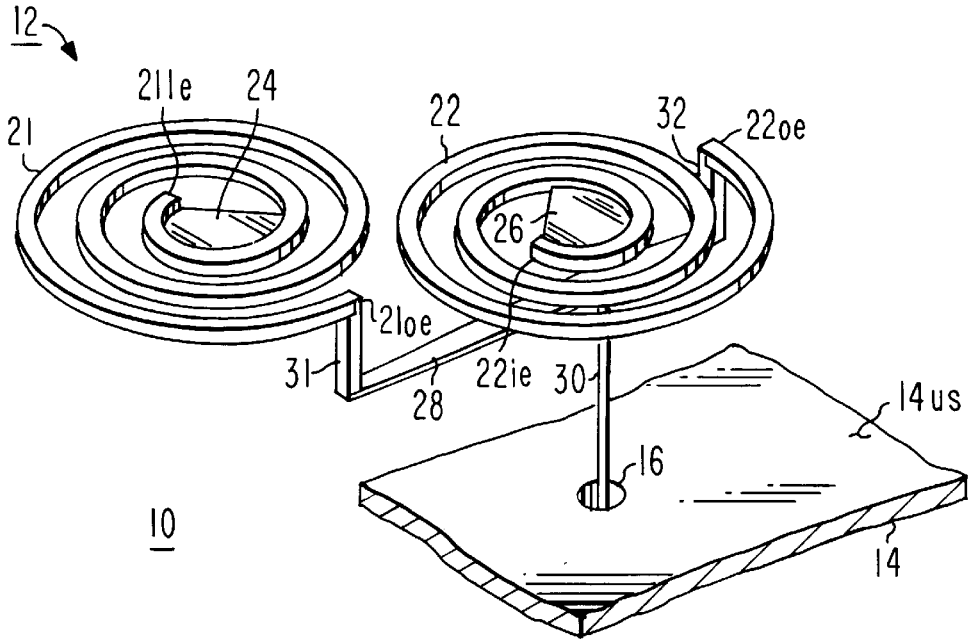
FIG. 1*a* is a simplified perspective or isometric view of an antenna according to an aspect of the invention.
Figure 1C:
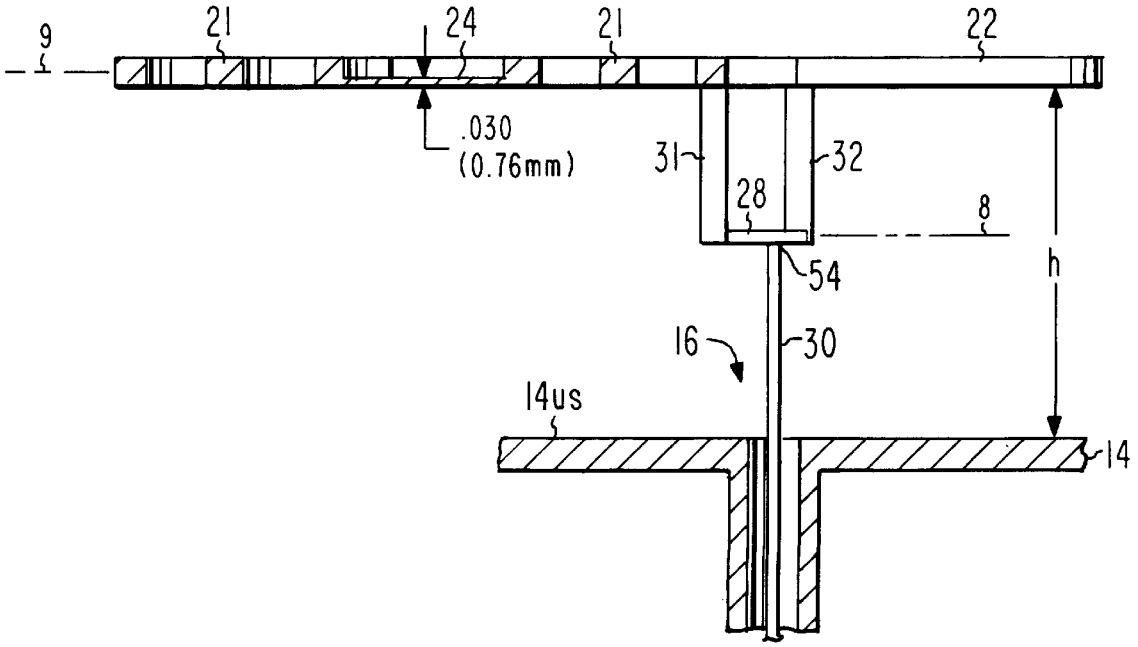
FIG. 1*c* is an elevation view of the antenna of FIG. 1*b* looking in the direction c—c.

In FIGS. 1*a*, 1*b*, 1*c*, 1*d*, and 1*e*, an antenna 10 includes windings designated generally as 12. Windings 12 includes a first electrical conductor 21 wound into an Archimedean spiral, and a second electrical conductor 22, wound into an identical spiral. An Archimedean spiral is one in which the element position S as a function of rotational angle θ is given as S=Rθ. In FIG. 1*a*, conductor or spiral 21 has a first or outer end 21*oe* and an second or inner end 21*ie*. Similarly, conductor or spiral 22 has a first or outer end 22*oe* and an second or inner end 22*ie*. Spiral conductors 21 and 22 are coplanar, and lie in a plane 9 (FIG. 1*c*). Outer end 21*oe* of spiral conductor 21 is connected to the upper end of a vertically disposed electrically conductive coupling element 31. Similarly, outer end 22*oe* of spiral conductor 22 is connected to the upper end of a vertically disposed electrically conductive coupling element 32. The bottom ends of coupling elements 31 and 32 are connected to the ends of a phase-shifting/impedance transforming electrically conductive element 28 (best seen in FIG. 1*d*), which lies in a plane 8 (FIG. 1*c*) parallel with plane 9. Plane 8 lies between plane 9 and the upper surface 14*us* of a ground plane 14.

It should be noted that a physical object cannot actually lie in a plane, because a conceptual plane has no thickness. Instead, a statement that "an object lies in a plane" means that the object in question is at least generally (or locally) planar, and has a thickness, that the plane lies parallel with the plane of the object and within the thickness (or possibly at the surface) of the object.

Figure 1B:
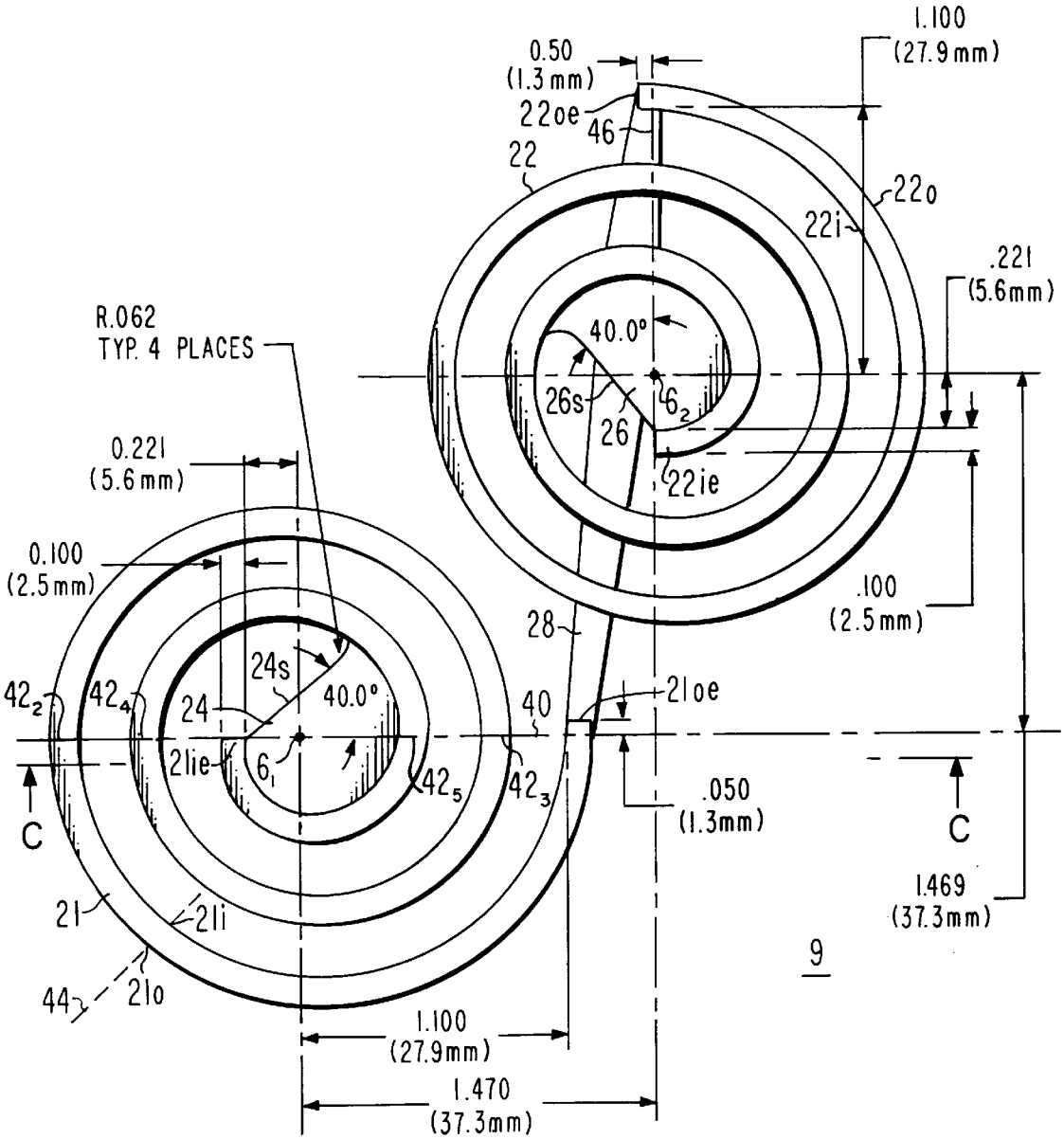
FIG. 1*b* is a plan view of the antenna of FIG. 1*a*.
Figure 1D:
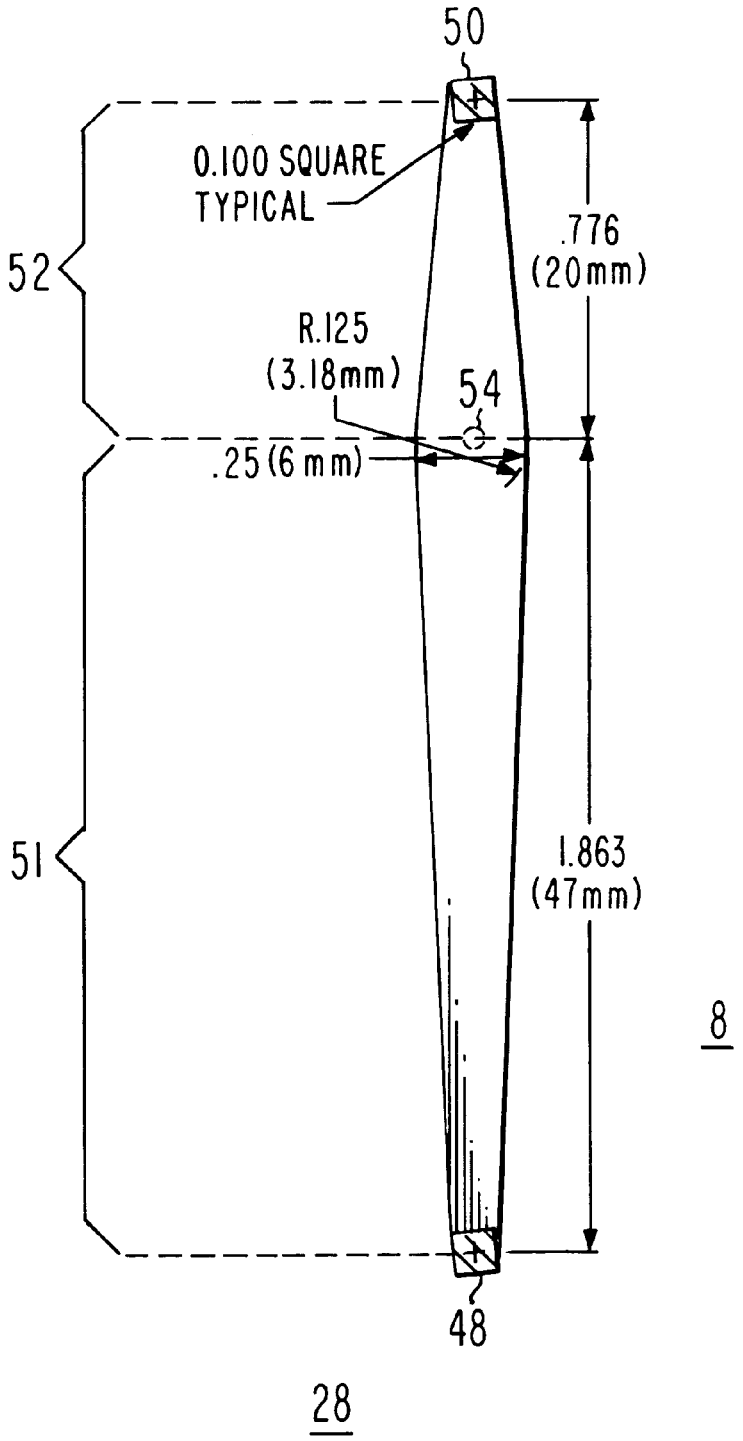
FIG. 1*d* is a plan view of a phase-shifting/impedance-transforming element of the antenna of FIG. 1*a*.
Figure 1E:
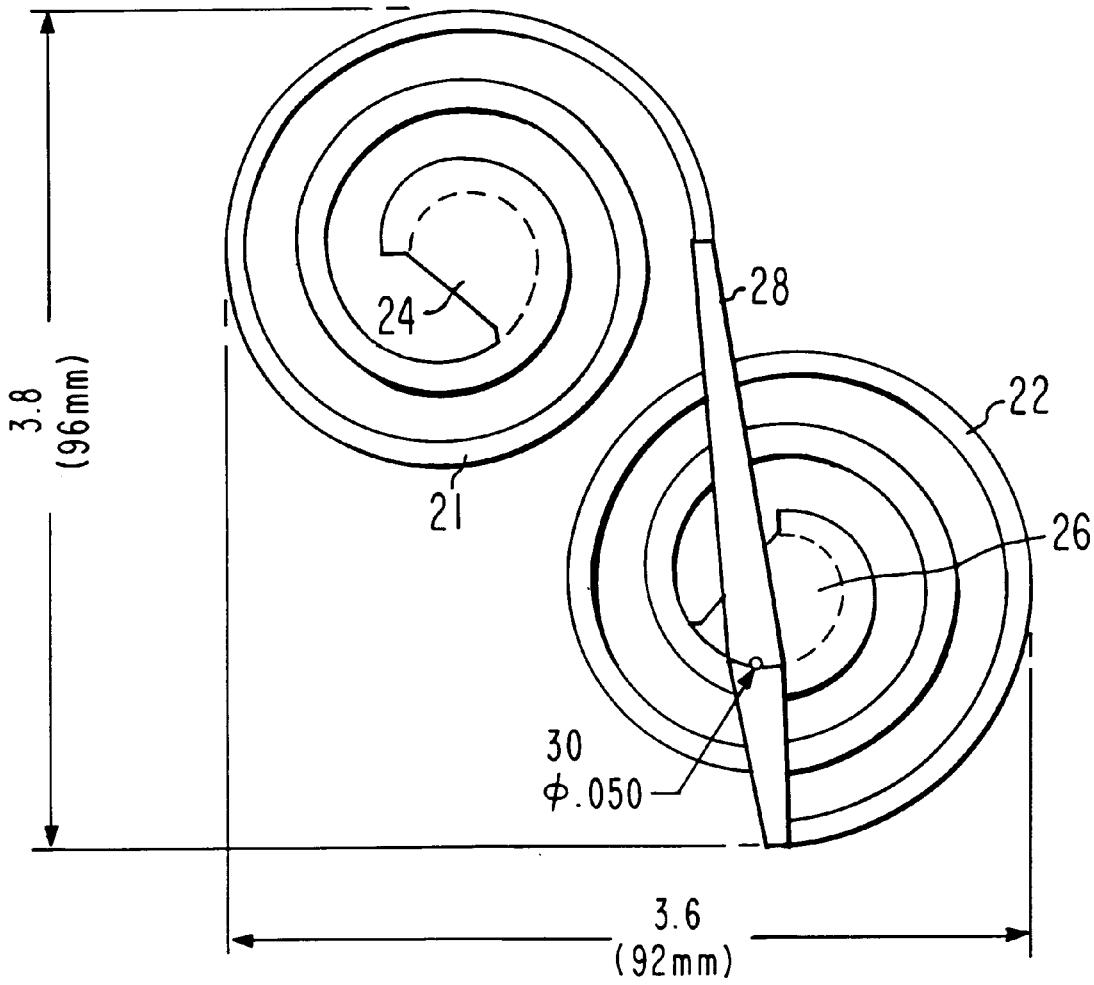
FIG. 1*e* is a bottom view of the antenna of FIG. 1*a*.

In FIG. 1*b*, the dot designated $\mathbf{6}_1$ is the center of spiral 21, and the dot designated $\mathbf{6}_2$ is the center of spiral 22. As illustrated in FIG. 1*b*, spiral 21 has 2 ½ turns. More particularly, a dash line 40 is illustrated as extending through center point 61 and through outside end 21*oe*. Starting from the intersection of line 40 with outer end 21*oe*, and proceeding along the element 21, first downward and to the left, and then upward and to the left, by 180° (relative to center point 61), one arrives at a second intersection $\mathbf{42}_2$ of line 40 with spiral conductor 21, and this constitutes one-half turn. Proceeding along spiral conductor 21 upward and to the right from intersection $\mathbf{42}_2$, then downward and to the right for a total of 180°, one arrives at a third intersection $\mathbf{42}_3$ of line 40 with spiral conductor 21. The sum of the two 180° segments totals 360° or one full turn. Proceeding in the same fashion from intersection $\mathbf{42}_3$, downward and to the left, then upward and to the left, one arrives at intersection $\mathbf{42}_4$. Proceeding upward and to the right from intersection $\mathbf{42}_4$, then downward and to the right, one arrives at intersection $\mathbf{42}_5$, for a total of two 360° rotations, or two complete turns. Proceeding further, downward and to the left from intersection $\mathbf{42}_5$, and then upward and to the left, one arrives at inner end 21*ie* of spiral conductor 21. This last path constitutes one-half turn, so the complete path taken from outer end 21*oe* to inner end 21*ie* is 2 ½ turns. Using the same method, it is easy to determine that spiral conductor 22 also has 2 ½ turns.

For purposes of definition in FIG. 1*b*, "inner" and "outer" edges of the spirally wound conductor 21 can be defined. At any point along the spiral conductor 21, the inner edge is that edge or surface which is closer to center point 61, and the outer edge is that edge or surface at the same location on the spiral which is more remote from center point 61. As an example, at the plane 44, transverse to the local axis of spiral 21, the inner edge or surface is designated 21*i*, and the outer edge or surface is designated 21*o*. In FIG. 1*b*, an electrically conductive plate 24, in conjunction with ground plane 14 (FIG. 1*a*) provides capacitance near the center of spiral conductor 21. More particularly, plate 24 has a curved edge contiguous (integral) with the inner edge 21*i* of spiral conductor 21 over the first half-turn as measured from inner end 21*ie*, and over an additional region. Plate 24 also has a nominally straight edge 24*s*, which extends from inner end 21*ie* of spiral conductor 21 to the inner surface 21*i* of conductor 21, making an angle of 40° with line 40.

Spiral conductor 22 of FIG. 1*b* is identical to spiral 21, in that it has 2 ½ turns, an inner end 22*ie*, an outer end 22*oe*, an inner edge 22*i*, an outer edge 22*o*, a defining line 46 passing through the center point and the outer end 22*oe*, and a capacitive plate 26. The capacitive plate 26 has a straight edge 26*s* which makes an angle of 40° with line 46. However, spiral conductors 21 and 22 are rotationally offset from each other by 90°, in that defining lines 40 and 46 are mutually orthogonal.

Phase shifting and impedance transforming element 28 of FIG. 1*c* lies in plane 8, and includes two end regions 48 and 50, to which conductive elements 31 and 32, respectively, are connected. Element 28 generally defines first and second regions 51 and 52, respectively. Region 51 extends from end region 48 to a "feed" point 54, and region 52 extends from end region 50 to feed point 54. In regions 51 and 52, the width of element 28 varies from narrow to thick with proximity to feed point 54. In general, the greater width of element 28 near feed point 54 represents more capacitance per unit length to the ground plane 14 (FIG. 1*a*). Thus, the capacitance per unit length along the length of element 28 decreases with increasing distance from the feed point 54, which corresponds with an impedance transformation from a relatively low impedance near feed point 54 and a relatively high impedance near ends 48 and 50.

Those skilled in the art know that antennas are reciprocal transducers, which exhibit similar properties in both transmission and reception modes of operation. For example, the antenna patterns for both transmission and reception are identical, and exhibit the same gain. For convenience of explanation, explanations and descriptions of antenna performance are often couched in terms of either transmission or reception, with the other mode of operation being understood therefrom. Thus, the terms "aperture illumination," "beam" or "radiation pattern" may pertain to either a transmission or reception mode of operation. For historical reasons, the antenna port or electrical connections are known as "feed" port or connections, even though the same port is used for both transmission and reception, and the term "beam" may apply to the entire radiation pattern or to a single lobe thereof.

Those skilled in the art also know that one of the salient characteristics of an antenna is its field polarization. There are two general classes of field polarization, one of which is linear, and the other of which is circular. In the case of linear polarization, the electric field vector of the radiated beam appears, at a given location far from the antenna, as a line, which may be oriented in any desired direction, as for example vertically or horizontally. In the case of circular polarization, on the other hand, the electric field vector rotates in a plane orthogonal to the direction of propagation at a rate related to the frequency of the propagating wave. It should be noted that the term "circular" polarization refers to a theoretical condition which is approached only on rare occasions, and the term "circular" is often applied to polarization properties which would more properly be termed "elliptical".

FIG. 1*c* illustrates how a coaxial structure 16 including a portion of electrical conductor 30 and a portion of ground plane 14 is coupled to feed point 54 of phase shifting and impedance transforming element 28. FIG. 1*c* also shows that plane 9 in which spirals 21 and 22 lie is at a height of h above the upper surface 14*us* of the ground plane 14. Dimension h is about 19.7 mm, which is about 0.13λ at the center of the operating frequency band.

Figure 2:
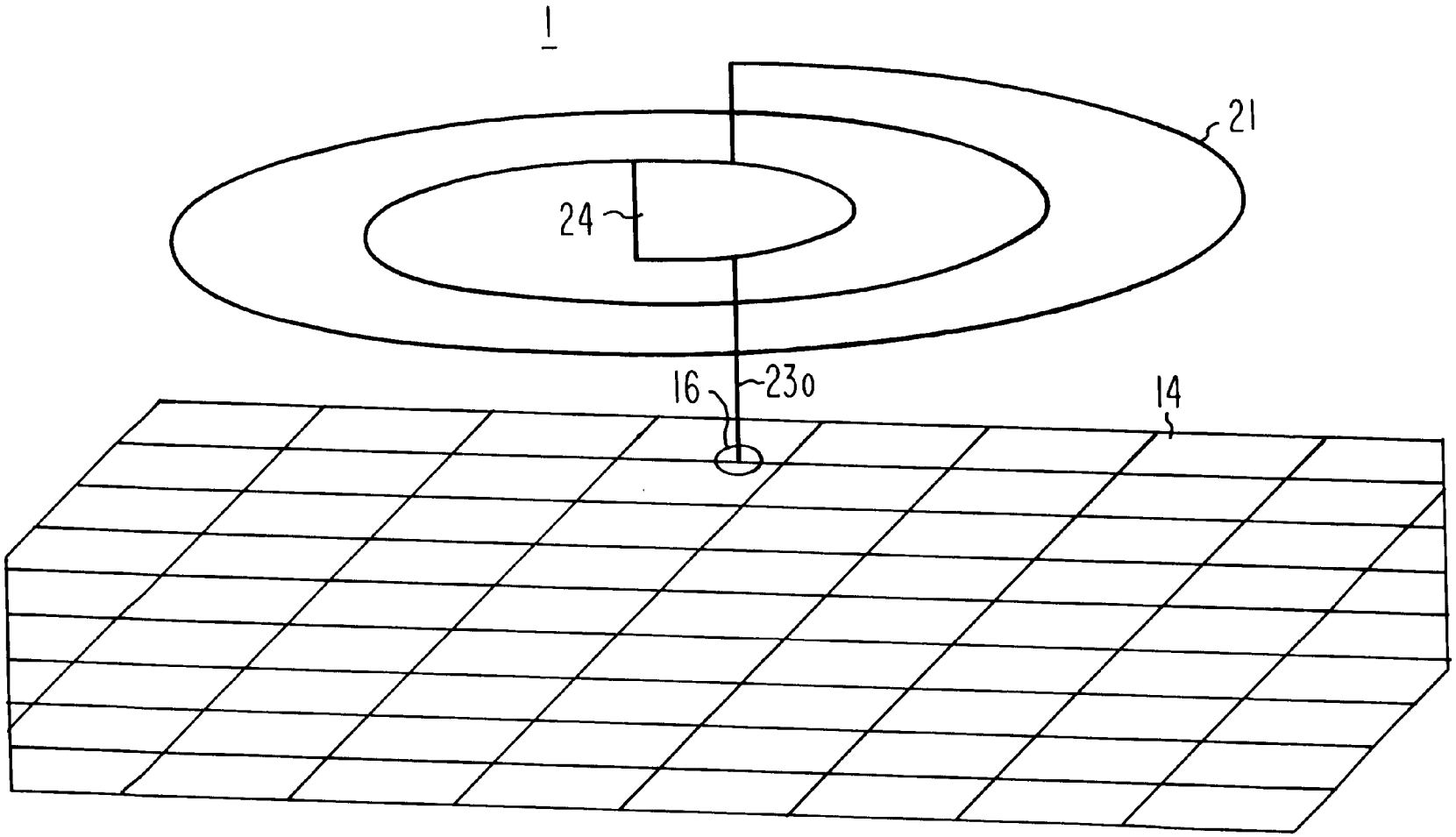
FIG. 2 is a simplified perspective or isometric view of a spiral antenna according to an aspect of the invention, driven from a coaxial port in a ground plane.
Figure 3:
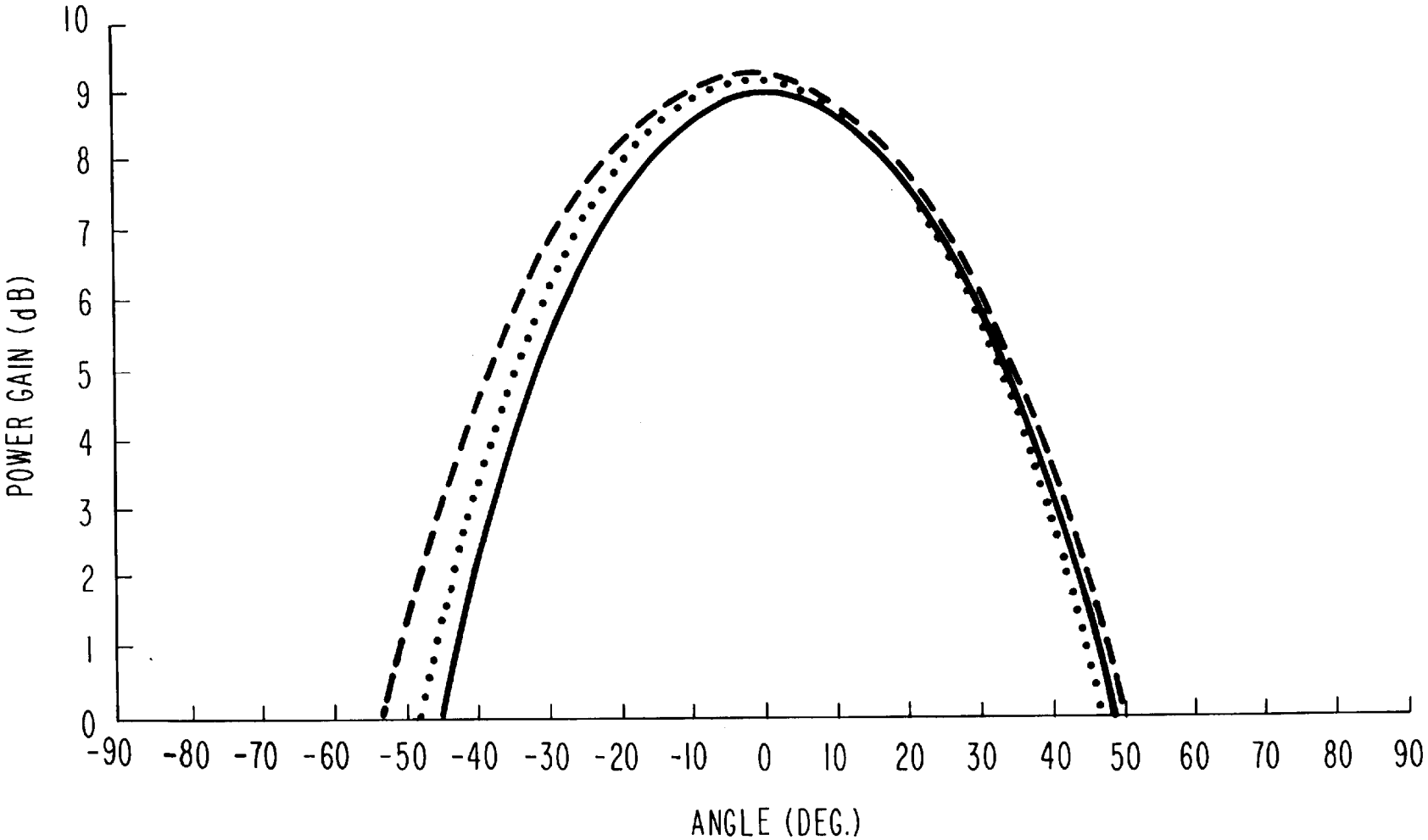
FIG. 3 plots the power gain of a single spiral antenna as in FIG. 2 versus angle, for three different operating frequencies.
Figure 4:
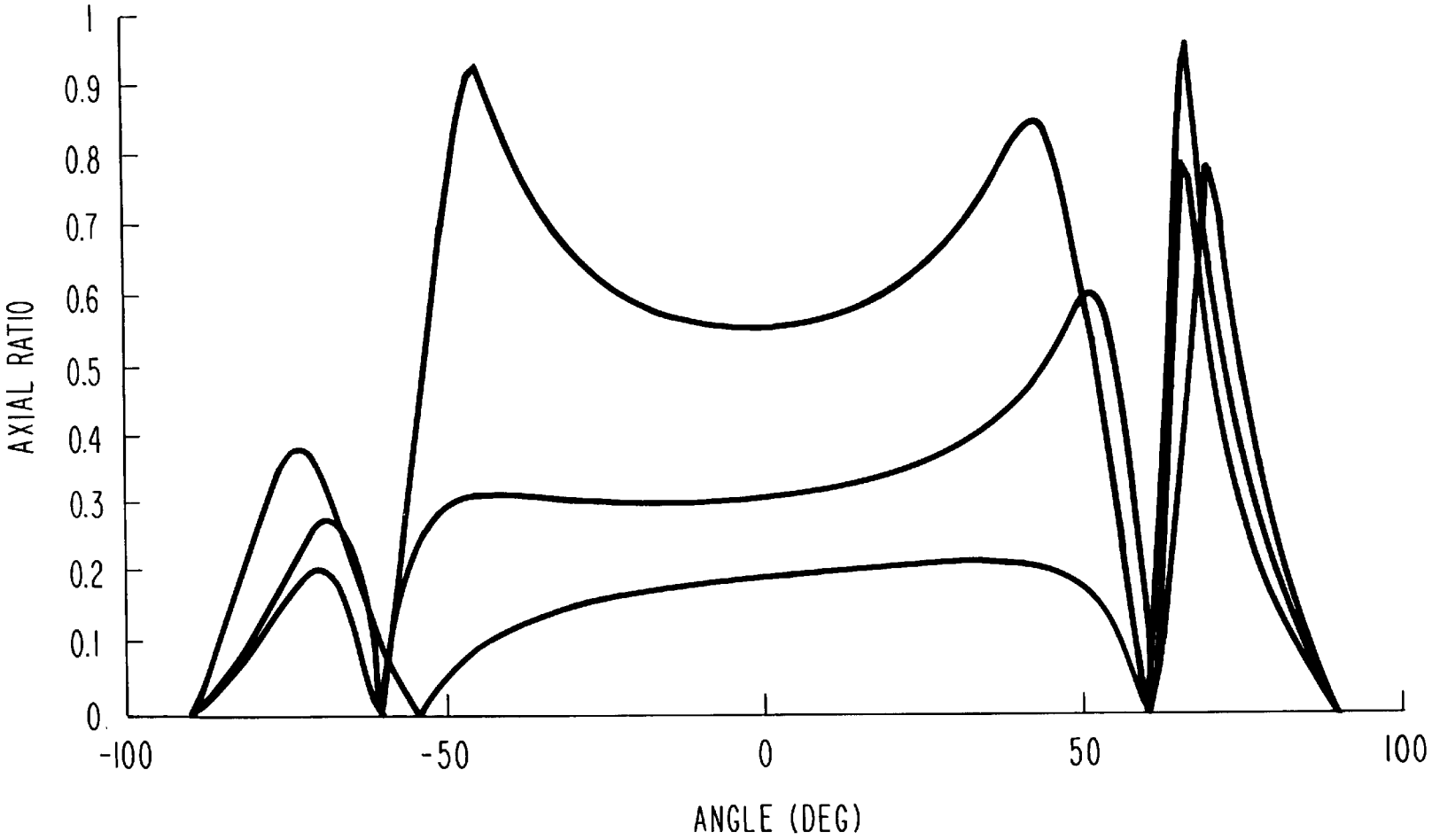
FIG. 4 plots axial ratio of the antenna of FIG. 2 for the same three operating frequencies.

FIG. 2 is a simplified perspective or isometric view of an antenna 1 using a spiral conductor such as 21 of FIGS. 1*a*, 1*b*, 1*c*, 1*d*, and 1*e*, driven from a coaxial port 16 in ground plane 14 by way of an electrically conductive element 230. FIG. 3 represents the power gain of a single conductive spiral as in FIG. 2 for three different frequencies, namely 1980 Mhz, 2090 MHz, and 2200 MHz. The gain is about 9 dB, Note that there is an asymmetry of the radiation pattern for the various frequencies, which may be attributable to the physical asymmetry of the structure of FIG. 2. More particularly, the coupling element 230 is at one side of the spiral, and is more visible from one aspect angle than another. FIG. 4 illustrates the axial ratio of the antenna of FIG. 2 for various different frequencies. In FIG. 4, plots 410, 412, and 414 represent frequencies of 1980 MHz, 2090 MHz, and 2200 MHz, respectively. The axial ratio is not exceptional for the single conductor antenna of FIG. 2.

Figure 5A:
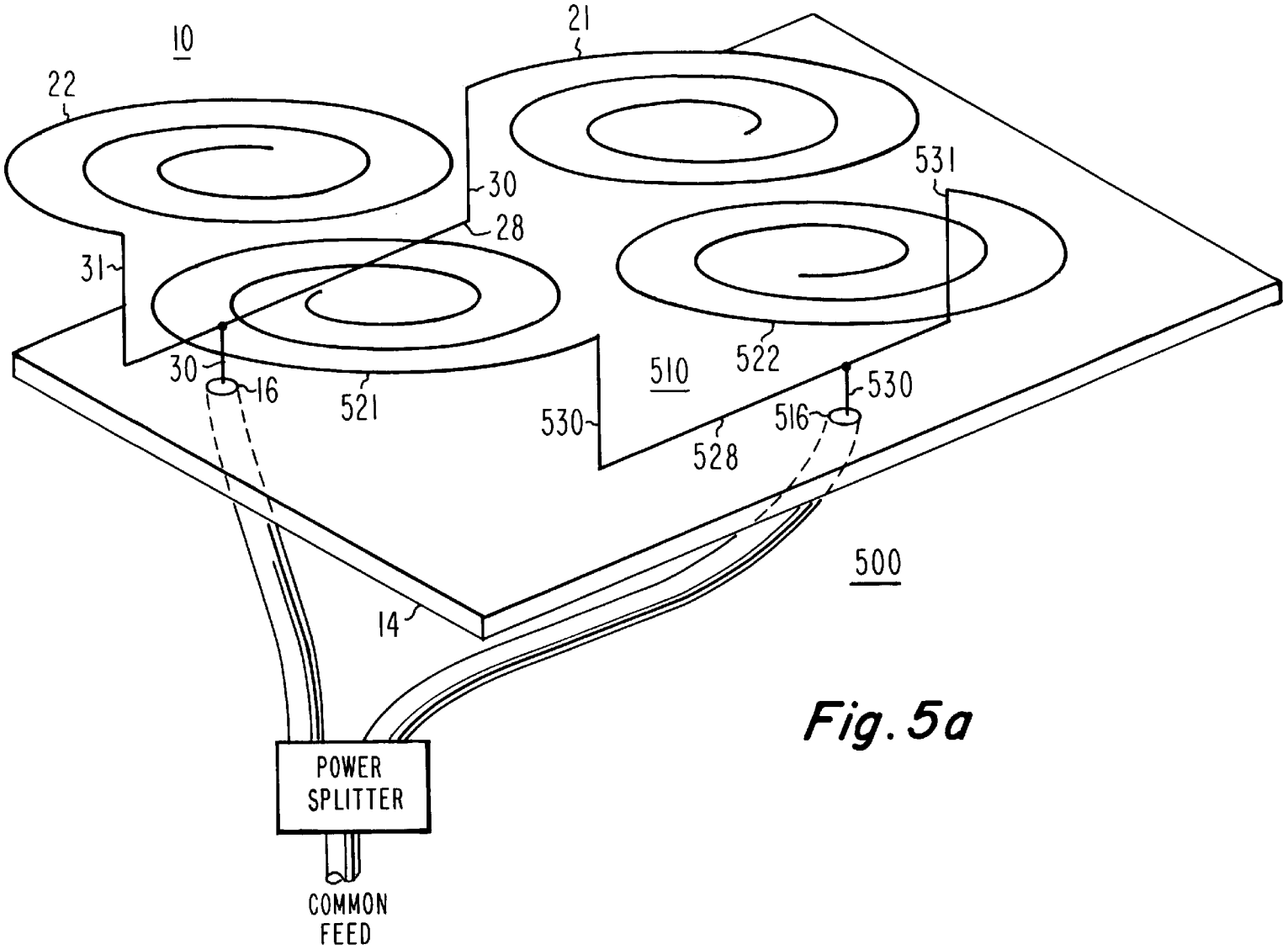
FIG. 5*a* is a perspective or isometric view of an array of two antennas as in FIGS. 1*a* through 1*e*.

In order to take advantage of the simplicity, planar structure, and relatively high gain of the antenna as in FIG. 2, two antennas as described in conjunction with FIGS. 1*a*, 1*b*, 1*c*, 1*d*, and 1*e* are arrayed to form an antenna 500, illustrated in FIG. 5*a*. In antenna 500, antenna 10 has its impedance transformation and phase shifting element 28 dimensioned to provide a 90° phase delay to spiral conductor 21 relative to spiral conductor 22. A second antenna 510, similar to antenna 10, is arrayed with antenna 10. In FIG. 5*a*, elements corresponding to those of FIGS. 1*a*, 1*b*, 1*c*, 1*d*, and 1*e* are designated by the same reference numerals, and newly added elements are designated by like reference numerals in the 500 series. Thus, antenna 500 of FIG. 5*a* includes spirals 521 and 522. Spirals 521 and 522 are fed at their outer ends by couplers 530 and 531, respectively, from impedance transforming and phase shifting element 528. Phase shifting element 528 is dimensioned to feed spiral 521 with a 90° lag relative to spiral 522. In FIG. 5*a*, antenna units 10 and 510 have a common ground plane 14, and are fed at coaxial ports 16 and 516, respectively. Antennas 10 and 510 of FIG. 5*a* are physically reversed, in that the elements fed with phase lags, namely spirals 21 and 521, are diametrically opposite to each other in the four-element array. This physical reversal tends to compensate axial ratio deviations attributable to asymmetry.

Figure 5B:
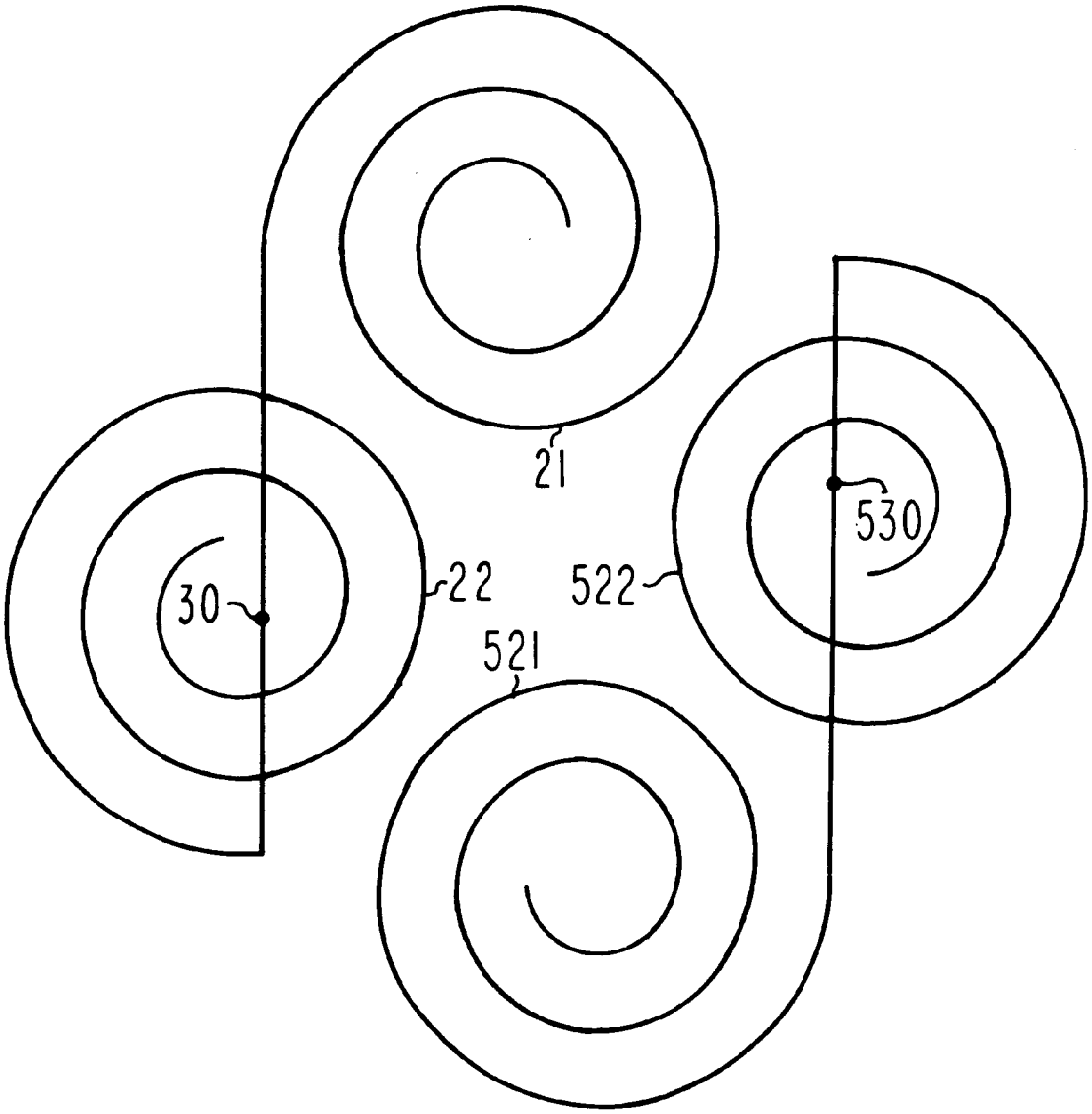
FIG. 5*b* is a plan view of the array of FIG. 5*a*.

FIG. 5*b* is a plan view of spiral conductors 21, 22, 521, and 522 of FIG. 5*a*, illustrating their positions.

Other embodiments of the invention will be apparent to those skilled in the art. For example, while the cross-section of the conductive elements, such as 21 or 22, have been illustrated as being square, flat and circular cross-sections are satisfactory, and even irregular cross-sections can be used. While 2 ½ turns have been illustrated, other numbers of turns may be used. The cross-sectional diameter or dimensions of the spiral-wound conductors may vary in dimension in accordance with the defining angle, or inversely therewith. Equiangular spirals may be used instead of Archimedean.

Thus, according to an aspect of the invention, an antenna (1, 10, 500) includes a ground plane (14), and an elongated, electrically conductive element (21, 22, 521, 522) in the form of a planar spiral lying parallel to the ground plane (14). The planar spiral element (21, 22, 521, 522) includes a central or inner end (21*ie*) and an outer end (21*oe*), and is centered near a point (61, 62) lying on a straight line (40, 46) connecting the central (21*ie*) and outer ends (21*oe*) of the spiral. The antenna (1, 10, 500) includes a capacitive element. The capacitive element comprises an electrically conductive plate (24, 26) lying parallel to the plane (9) of the planar spiral (21, 22). The plate (24, 26) has a straight side (24*s*) and a curved side. The curved side of the plate (24, 26) is contiguous with or affixed to an inner edge (21*i*, 22*i*) of the elongated electrically conductive element (21, 22) at locations extending from the central end (21*ie*), over a first half-turn of the spiral, and beyond the first half-turn to a point at which the straight side (24*s*) of the plate (24, 26) makes a particular angle with the line (40, 46). The antenna (1, 10, 500) also includes a feed arrangement (16, 28, 30, 31, 32) coupled to the ground plane (14) and to the outer end (21*oe*) of the electrically conductive element (21, 22, 521, 522).

In a particular embodiment of the invention, the planar spiral (21, 22, 521, 522) is an Archimedean spiral, having more than two turns, and more particularly having 2 ½ turns, and the particular angle is 40°.

An antenna (1, 10, 500) according to another embodiment of the invention includes a ground plane (14) and a first elongated electrically conductive element (21, 22, 521, 522) in the form of a first planar spiral (21) lying parallel to the ground plane (14). The first planar spiral (21) includes a central end (21*ie*) and an outer end (21*oe*), and is centered near a point (61) lying on a first straight line (40, 46) connecting the central (21*ie*) and outer (21*oe*) ends of the first planar spiral (21). The antenna (1, 10, 500) according to this other embodiment of the invention includes a second elongated electrically conductive element (22) in the form of a second planar spiral, which is coplanar with the first planar spiral. The second planar spiral (22) includes a central end (21*ie*) and an outer end (21*oe*), and is centered near a point (62) lying on a second straight line (40, 46) connecting the central (21*ie*) and outer (21*oe*) ends of the second planar spiral (21). An elongated electrically conductive phasing element (28) extends, parallel with the ground plane (14) and between the ground plane (14) and the first (21) and second (22) spirals, from a first location (48) to a second location (50). The first location (48) lies on a line extending orthogonal to the ground plane (14) and through the outer end (21*oe*) of the first planar spiral (21), and the second location lies on a line extending orthogonal to the ground plane (14) and through the outer end (21*oe*) of the second planar spiral (22). An electrical conductor (31) extends from the elongated electrically conductive phasing element (28) at the first location (48) to the outer end (21*oe*) of the first spiral (21), and another electrical conductor (32) extends from the elongated electrically conductive phasing element (28) at the second location (50) to the outer end (21*oe*) of the second spiral (22). A feed arrangement (16, 30) is coupled to the ground plane (14) and to a particular location (54) on the electrically conductive phasing element (28), which particular location lies between the first (48) and second (50) locations. In this embodiment, the dimensioning of the electrically conductive phasing element may be selected to provide a 90° difference in phase at a selected operating frequency between the feed signals at the outer end (21*oe*)s of the first (21) and second (22) spirals.

In a particular embodiment of the invention, the antenna (1, 10, 500) further includes a first capacitive element comprising a first electrically conductive plate (24, 26) lying parallel to the plane (9) of the first planar spiral (21). The first electrically conductive plate (24, 26) has a straight side (24*s*) and a curved side. The curved side is affixed to or contiguous with at least one edge (21*i*) of the elongated electrically conductive element (21) of the first planar spiral at locations extending from the central end (21*ie*), over a first half-turn of the first planar spiral, and beyond the first half-turn to a point at which the straight side of the plate (24, 26) makes an angle, which in one embodiment may be about 40°, with the line (40, 46).

In another particular embodiment of the invention, the antenna (1, 10, 500) further includes a second capacitive element (24, 26) comprising a second electrically conductive plate (24, 26) lying parallel to the plane of the second planar spiral. The second plate (24, 26) has a straight side and a curved side. The curved side is affixed to an edge of the elongated electrically conductive element of the second planar spiral at locations extending from the central end (21*ie*), over a first half-turn of the second planar spiral, and beyond the first half-turn to a point at which the straight side of the plate (24, 26) makes the particular angle with the line (40, 46).

In another embodiment, the first and second planar spirals are oriented relative to each other in such a fashion that the line (40, 46) extending from the central to the outer end (21*oe*) of the first planar spiral is orthogonal to the line (40, 46) extending from the central to the outer end (21*oe*) of the second planar spiral.

What is claimed is:

1. An antenna, comprising:

a ground plane:

an elongated electrically conductive element in the form of a planar spiral lying parallel to said ground plane, said planar spiral including a central end and an outer end, and being centered near a point lying on a straight line connecting said central and outer ends of said spiral;

a capacitive element comprising an electrically conductive plate lying parallel to the plane of said planar spiral, said plate having a straight side and a curved side, said curved side being affixed to at least an interior edge of said elongated electrically conductive element at locations extending from said central end, over a first half-turn of said spiral, and beyond said first half-turn to a point at which said straight side of said plate makes a particular angle with said line; and feed means coupled to said ground plane and to said outer end of said electrically conductive element.

2. An antenna according to claim 1, wherein said planar spiral is an Archimedean spiral.

3. An antenna according to claim 1, wherein said planar spiral has more than two turns.

4. An antenna according to claim 3, wherein said planar spiral has 2 ½ turns.

5. An antenna according to claim 1, wherein said particular angle is about 40°.

6. An antenna, comprising:

a ground plane:

a first elongated electrically conductive element in the form of a first planar spiral lying parallel to said ground plane, said first planar spiral including a central end and an outer end, and being centered near a point lying on a first straight line connecting said central and outer ends of said first planar spiral;

a second elongated electrically conductive element in the form of a second planar spiral coplanar with said first planar spiral, said second planar spiral including a central end and an outer end, and being centered near a point lying on a second straight line connecting said central and outer ends of said second planar spiral;

an elongated electrically conductive phasing element extending parallel with said ground plane and between said ground plane and said first and second spirals, from a first location to a second location, said first location lying on a line extending orthogonal to said ground plane and through said outer end of said first planar spiral, and said second location lying on a line extending orthogonal to said ground plane and through said outer end of said second planar spiral;

electrically conductive means extending from said elongated electrically conductive phasing element at said first location to said outer end of said first spiral;

electrically conductive means extending from said elongated electrically conductive phasing element at said second location to said outer end of said second spiral; and feed means coupled to said ground plane and to a location on said electrically conductive phasing element, which location lies between said first and second locations.

7. An antenna according to claim 6, further including:

a first capacitive element comprising an electrically conductive plate lying parallel to the plane of said first planar spiral, said plate having a straight side and a curved side, said curved side being affixed to an interior edge of said elongated electrically conductive element of said first planar spiral at locations extending from said central end, over a first half-turn of said first planar spiral, and beyond said first half-turn to a point at which said straight side of said plate makes an angle of 40° with said line.

8. An antenna according to claim 6, further including:

a second capacitive element comprising an electrically conductive plate lying parallel to the plane of said second planar spiral, said plate having a straight side and a curved side, said curved side being affixed to an interior edge of said elongated electrically conductive element of said second planar spiral at locations extending from said central end, over a first half-turn of said second planar spiral, and beyond said first half-turn to a point at which said straight side of said plate makes an angle of 40° with said line.

9. An antenna according to claim 6, wherein said first and second planar spirals are oriented relative to each other in such a fashion that said line extending from said central to said outer end of said first planar spiral is orthogonal to said line extending from said central to said outer end of said second planar spiral.

10. An antenna according to claim 6, wherein said location on said electrically conductive phasing element is selected to provide a 90° difference in phase between the feed signals at said outer ends of said first and second spirals at a selected operating frequency.

* * * * *

UNITED STATES PATENT AND TRADEMARK OFFICE

CERTIFICATE OF CORRECTION

PATENT NO. : 6,067,058
DATED : May 23, 2000
INVENTOR(S) : Vladimir Volman

It is certified that error appears in the above-identified patent and that said Letters Patent is hereby corrected as shown below:

Title page,
Item [73], change "Lockhead Martin Corporation" to -- Lockheed Martin Corporation --.

Signed and Sealed this

Seventh Day of May, 2002

*Attest:*

*Attesting Officer*

JAMES E. ROGAN
*Director of the United States Patent and Trademark Office*